US007272943B2

(12) United States Patent
Hwang et al.

(10) Patent No.: US 7,272,943 B2
(45) Date of Patent: Sep. 25, 2007

(54) CONTROL METHOD FOR MULTIPLE HEAT PUMP

(75) Inventors: Il Nahm Hwang, Ansan-si (KR); Sai Kee Oh, Seoul (KR); Yoon Been Lee, Seoul (KR); Se Dong Chang, Kwangmyung-si (KR)

(73) Assignee: LG Electronics Inc., Seoul (KR)

( * ) Notice: Subject to any disclaimer, the term of this patent is extended or adjusted under 35 U.S.C. 154(b) by 175 days.

(21) Appl. No.: 11/063,588

(22) Filed: Feb. 24, 2005

(65) Prior Publication Data

US 2005/0193749 A1 Sep. 8, 2005

(30) Foreign Application Priority Data

Feb. 25, 2004 (KR) ..... 10-2004-0012585

(51) Int. Cl.
*F25B 5/00* (2006.01)

(52) U.S. Cl. ..... 62/117; 62/126; 62/130

(58) Field of Classification Search ..... 62/117, 62/126, 129, 160, 203, 414, 238.7
See application file for complete search history.

(56) References Cited

U.S. PATENT DOCUMENTS 5,142,879 A * 9/1992 Nakamura et al. ..... 62/160
5,159,817 A * 11/1992 Hojo et al. ..... 62/81
5,297,392 A * 3/1994 Takata et al. ..... 62/160
5,347,826 A * 9/1994 Hayashida et al. ..... 62/197
5,388,422 A * 2/1995 Hayashida et al. ..... 62/211
5,709,090 A * 1/1998 Endo et al. ..... 62/81
5,860,286 A * 1/1999 Tulpule ..... 62/129
6,035,653 A * 3/2000 Itoh et al. ..... 62/228.4
6,279,330 B1 * 8/2001 Ueno et al. ..... 62/77
6,343,482 B1 * 2/2002 Endo et al. ..... 62/324.6

FOREIGN PATENT DOCUMENTS

| | | | |
|---|---|---|---|
| EP | 0854331 A2 * | 7/1998 | |
| JP | 5-248722 A | 9/1993 | |
| JP | 8-114359 A | 5/1996 | |
| JP | 8-178447 A | 7/1996 | |
| JP | 9-42783 A * | 2/1997 | |
| JP | 9-145191 A | 6/1997 | |
| WO | WO-03/081140 A1 | 10/2003 | |

* cited by examiner

*Primary Examiner*—Mohammad M. Ali
(74) *Attorney, Agent, or Firm*—Birch, Stewart, Kolasch & Birch, LLP

(57) ABSTRACT

Disclosed herein is a control method for a multiple heat pump. In the control method, when one of multiple indoor units operates in the heating mode and the other indoor units shut down, electronic expansion valves of the shutdown indoor units are controlled to have an opening degree higher than a standard opening degree if an outlet temperature of compressors is higher than a preset temperature, so as to permit a liquid refrigerant, remaining in the shutdown indoor units, to be more readily recovered to the compressors. This eliminates a refrigerant shortage phenomenon of the compressors and prevents deterioration of heating performance as well as reduction of life-span of the compressors.

16 Claims, 8 Drawing Sheets

CONTROL METHOD FOR MULTIPLE HEAT PUMP

BACKGROUND OF THE INVENTION

1. Field of the Invention

The present invention relates to a multiple heat pump, and more particularly, to a control method for a multiple heat pump which can return a liquid refrigerant, remaining in shutdown indoor units, into compressors when only one of multiple indoor units operates in a heating mode.

2. Description of the Related Art

FIG. 1 is a schematic cycle diagram illustrating refrigerant flow in a cooling mode of a conventional multiple heat pump. FIG. 2 is a schematic cycle diagram illustrating refrigerant flow in a heating mode of the conventional multiple heat pump. FIG. 3 is a schematic cycle diagram illustrating refrigerant flow when one of multiple indoor units of the conventional multiple heat pump operates in a heating mode and the other indoor units shut down.

As shown in FIGS. 1 to 3, the conventional multiple heat pump comprises multiple indoor units 1, 2, 3 and 4. Each of the indoor units 1, 2, 3 or 4 is provided with an indoor blower 5, 6, 7 or 8 that suctions indoor air thereinto and discharges it again to a room, and an indoor heat exchanger 11, 12, 13 or 14 that heat exchanges the indoor air, suctioned into the indoor unit, with a refrigerant so as to heat or cool the air.

The conventional multiple heat pump further comprises a single outdoor unit 20 including compressors 22, an accumulator 26, oil separators 30, an outdoor heat exchanger 34 and a four-way valve 38. The compressors 22 are used to compress a refrigerant, and the accumulator 26, connected to refrigerant suction pipes 24 of the compressors 22, is used to accumulate a liquid refrigerant in order to permit only a gas refrigerant to be introduced into the compressors 22. The oil separators 30 are connected to refrigerant discharge pipes 28 of the respective compressors 22 in order to separate oil discharged together with the refrigerant from the compressors 22. The outdoor heat exchanger 34 is used to heat exchange the refrigerant with outside air. The four-way valve 38 is connected to the oil separators 30, indoor heat exchangers 11, 12, 13 and 14, accumulator 26 and outdoor heat exchanger 34 via refrigerant pipes 36*a*, 36*b*, 36*c* and 36*d*, and is used to switch a refrigerant channel in order to selectively send the refrigerant, passed through the oil separators 30, to the indoor heat exchangers 11, 12, 13 and 14 or outdoor heat exchanger 34.

An additional refrigerant pipe 36 is provided to directly connect the outdoor heat exchanger 34 to the respective indoor heat exchangers 11, 12, 13 and 14. The refrigerant pipe 36 is provided with an expansion mechanism that expands the refrigerant, passed through the outdoor heat exchanger 34 or indoor heat exchangers 11, 12, 13 and 14, to a low-temperature and low-pressure refrigerant.

The expansion mechanism includes indoor electronic expansion valves 15, 16, 17 and 18 mounted in the respective indoor units 1, 2, 3 and 4 to permit the refrigerant passing therethrough to expand in cooling/heating modes, and an outdoor expansion device 40 mounted in the outdoor unit 20 to permit passage of the refrigerant only in the heating mode.

The outdoor expansion device 40 includes a check valve 42, a bypass pipe 44, and an outdoor electronic expansion valves 46. The check valve 42 is provided at the refrigerant pipe 36 connected to the outdoor heat exchanger 34 and is used to pass the refrigerant in the cooling mode and obstruct the refrigerant in the heating mode. The bypass pipe 44 serves to divert the refrigerant obstructed by the check valve 42, and the outdoor electronic expansion valve 46 serves to expand the refrigerant passing through the bypass pipe 44.

Now, the operation of the conventional multiple heat pump configured as stated above will be explained.

When all of the indoor units 1, 2, 3 and 4 operate in a cooling mode, as shown in FIG. 1, the four-way valve 38 is switched to send a high-temperature and high-pressure gas refrigerant, emerged from the compressors 22, to the outdoor heat exchanger 34. While passing through the outdoor heat exchanger 34, the high-temperature and high-pressure gas refrigerant is heat exchanged with the surrounding air, thereby being condensed to a liquid refrigerant. The liquid refrigerant is transferred to the respective indoor units 1, 2, 3 and 4 through the check valve 42.

The liquid refrigerant, transferred to the respective indoor units 1, 2, 3 and 4, is expanded to a two-phase refrigerant containing both liquid and gas by the indoor electronic expansion valves 15, 16, 17 and 18, and then is introduced into the indoor heat exchangers 11, 12, 13 and 14 of the respective indoor units 1, 2, 3 and 4. While passing through the indoor heat exchangers 11, 12, 13 and 14, the two-phase refrigerant absorbs the surrounding heat as it is evaporated to a refrigerant vapor, thereby allowing the multiple indoor units 1, 2, 3 and 4 to function as coolers. Meanwhile, the refrigerant vapor, passed through the indoor heat exchangers 11, 12, 13 and 14, is transferred again to the outdoor unit 20, and is sent to the accumulator 26 by the four-way valve 38, thereby being finally circulated to the compressors 22. In this way, a cooling cycle is completed.

On the contrary, when all of the indoor units 1, 2, 3 and 4 operate in a heating mode, as shown in FIG. 2, the four-way valve 38 is switched to send a high-temperature and high-pressure gas refrigerant, emerged from the compressors 22, to the respective indoor units 1, 2, 3 and 4, opposite to the above described cooling mode.

The high-temperature and high-pressure gas refrigerant, transferred to the respective indoor units 1, 2, 3 and 4, emits heat to the surroundings as it is condensed to a liquid refrigerant while passing through the indoor heat exchangers 11, 12, 13 and 14, thereby allowing the multiple indoor units 1, 2, 3 and 4 to function as heaters.

The liquid refrigerant, passed through the indoor heat exchangers 11, 12, 13 and 14, is expanded to a two-phase refrigerant containing both liquid and gas by the respective indoor electronic expansion valves 15, 16, 17 and 18, and then is transferred to the outdoor unit 20.

The two-phase refrigerant, transferred into the outdoor unit 20, passes the bypass pipe 44 since it is obstructed by the check valve 42. Thereby, the refrigerant is expanded by the outdoor electronic expansion valve 46 provided at the bypass pipe 44, and is introduced into the outdoor heat exchanger 34, so that it is evaporated to a refrigerant vapor as it is heat exchanged with the surrounding air while passing through the outdoor heat exchanger 34. The refrigerant vapor is sent to the four-way valve 38.

The refrigerant vapor, sent to the four-way valve 38, is circulated to the compressors 22 after passing through the accumulator 26, completing a heating cycle.

Meanwhile, such a conventional multiple heat pump air conditioning system operates in such a fashion that one of the multiple indoor units 4 operates in a heating mode and the other indoor units 1, 2 and 3 shut down. In this case, the electronic expansion valve 18 of the indoor unit 4, operating in the heating mode, is controlled to attain a desired opening degree higher than a standard opening degree, whereas the electronic expansion valves 15, 16 and 17 of the shutdown indoor units 1, 2 and 3 are closed to the standard opening degree.

As can be seen from FIG. 3, the liquid refrigerant, passed through the indoor heat exchanger 14 of the operating indoor unit 4, is expanded to a low-temperature and low-pressure refrigerant while passing through the indoor electronic expansion valve 18 of the operating indoor unit 4, and then is circulated to the compressors 22 by successively passing through the outdoor electronic expansion valve 46, outdoor heat exchanger 34, four-way valve 38 and accumulator 26 of the outdoor unit 20. On the other hand, the electronic expansion valves 15, 16 and 17 of the shutdown indoor units 1, 2 and 3 are closed. This causes the liquid refrigerant to remain in the indoor heat exchangers 11, 12 and 13 of the shutdown indoor units 1, 2 and 3.

The fact that the liquid refrigerant remains in the indoor heat exchangers 11, 12 and 13 of the shutdown indoor units 1, 2 and 3 when only the indoor unit 4 operates in the heating mode means that a lesser amount of refrigerant is circulated to the compressors 22, causing a reduced cooling efficiency and overheating of the compressors 22. Such an overheating of the compressors 22 increases an outlet side temperature of the compressors, resulting in a deterioration of heating performance as well as damage and shorter life-span of the compressors 22.

SUMMARY OF THE INVENTION

Therefore, the present invention has been made in view of the above problems, and it is an object of the present invention to provide a control method for a multiple heat pump which can return a liquid refrigerant, remaining in shutdown indoor units, into compressors when only one of multiple indoor units operates in a heating mode, so as to enhance cooling efficiency of the compressors using the refrigerant, thereby extending life-span of the compressors as well as improving heating performance.

In accordance with one aspect of the present invention, the above and other objects can be accomplished by the provision of a control method for a multiple heat pump having multiple indoor units connected to an outdoor unit, the indoor units being controlled to operate in a cooling or heating mode, the method comprising: controlling electronic expansion valves of shutdown indoor units to attain an opening degree higher than a standard opening degree if an outlet temperature of compressors is higher than a first preset temperature, in a state in which one of the multiple indoor units operates in the heating mode; and returning the opening degree of the electronic expansion valves of the shutdown indoor units to the standard opening degree if the outlet temperature of the compressors is below a second preset temperature, after completing control of the electronic expansion valves to the opening degree higher than the standard opening degree.

Preferably, the outlet temperature of the compressors may be a temperature sensed by outlet temperature sensors provided at refrigerant discharge pipes of the compressors.

Preferably, the standard opening degree may be a standard preset opening degree upon shutdown of the indoor units.

Preferably, the second preset temperature may be lower than the first preset temperature.

In accordance with another aspect of the present invention, the above and other objects can be accomplished by the provision of a control method for a multiple heat pump having multiple indoor units connected to an outdoor unit, the indoor units being controlled to operate in a cooling or heating mode, the method comprising: opening a bypass valve to permit part of a refrigerant to be diverted and recovered to compressors after being expanded and increasing an opening degree of electronic expansion valves of shutdown indoor units if an outlet temperature of the compressors is higher than a first preset temperature, in a state in which one of the multiple indoor units operates in the heating mode; and returning the opening degree of the electronic expansion valves of the shutdown indoor units to a standard opening degree if the outlet temperature of the compressors is below a second preset temperature, during increase of the opening degree of the electronic expansion valves.

Preferably, the outlet temperature of the compressors may be a temperature sensed by outlet temperature sensors provided at refrigerant discharge pipes of the compressors.

Preferably, the refrigerant, expanded in the electronic expansion valves of the multiple indoor units, may be diverted as the bypass valve is opened.

Preferably, the increase of the opening degree of the electronic expansion valves may be performed in a stepwise manner.

Preferably, the increase of the opening degree of the electronic expansion valves may be performed so that the opening degree reaches a preset opening degree higher than the standard opening degree.

Preferably, the second preset temperature may be lower than the first preset temperature.

Preferably, the standard opening degree may be a standard preset opening degree upon shutdown of the indoor units.

Preferably, the return of the opening degree of the electronic expansion valves to the standard opening degree may be performed by closing the bypass valve.

In accordance with yet another aspect of the present invention, the above and other objects can be accomplished by the provision of a control method for a multiple heat pump having multiple indoor units connected to an outdoor unit, the indoor units being controlled to operate in a cooling or heating mode, the method comprising: opening a bypass valve to permit part of a refrigerant to be diverted and recovered to compressors after being expanded and controlling electronic expansion valves of shutdown indoor units to attain a first opening degree higher than a standard opening degree if an outlet temperature of the compressors is higher than a first preset temperature, in a state in which one of the multiple indoor units operates in the heating mode; controlling the electronic expansion valves of the shutdown indoor units to attain a second opening degree higher than the first opening degree if the outlet temperature of the compressors is higher than a second preset temperature, after completing control of the electronic expansion valves to the first opening degree; and returning the opening degree of the electronic expansion valves of the shutdown indoor units to the standard opening degree if the outlet temperature of the compressors is below a third preset temperature, after completing control of the electronic expansion valves to the second opening degree.

Preferably, the refrigerant, expanded in the electronic expansion valves of the multiple indoor units, may be diverted as the bypass valve is opened.

Preferably, the standard opening degree may be a standard preset opening degree upon shutdown of the indoor units.

Preferably, the first opening degree may be a value below a fifth of a maximum opening degree of the electronic expansion valves of the indoor units.

Preferably, the second preset temperature may be higher than the first preset temperature.

Preferably, the second opening degree may be a value above a fifth of a maximum opening degree of the electronic expansion valves and below the maximum opening degree.

Preferably, the third preset temperature may be lower than the first preset temperature.

Preferably, the return of the opening degree of the electronic expansion valves to the standard opening degree may be performed by closing the bypass valve.

With such a control method for a multiple heat pump according to the present invention, when one of multiple indoor units operates in a heating mode and the other indoor units shut down, electronic expansion valves of the shutdown indoor units are controlled to have an opening degree higher than a standard opening degree if an outlet temperature of compressors is higher than a preset temperature, so as to permit a liquid refrigerant, remaining in the shutdown indoor units, to be recovered to the compressors. This can solve a conventional refrigerant shortage problem of the compressors, preventing a deterioration of heating performance and a reduction of life-span of the compressors.

Further, according to the control method for the multiple heat pump of the present invention, when one of multiple indoor units operates in the heating mode and the other indoor units shut down, a bypass valve is opened and the electronic expansion valves of the shutdown indoor units are controlled to have the opening degree higher than the standard opening degree if the outlet temperature of compressors is higher than the preset temperature, so as to permit the liquid refrigerant, remaining in the shutdown indoor units, to be more readily recovered to the compressors.

Furthermore, the control method for the multiple heat pump according to the present invention can stepwise increase the opening degree of the electronic expansion valves of the shutdown indoor units, minimizing heating effects of the shutdown indoor units and enabling rapid recovery of the liquid refrigerant.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
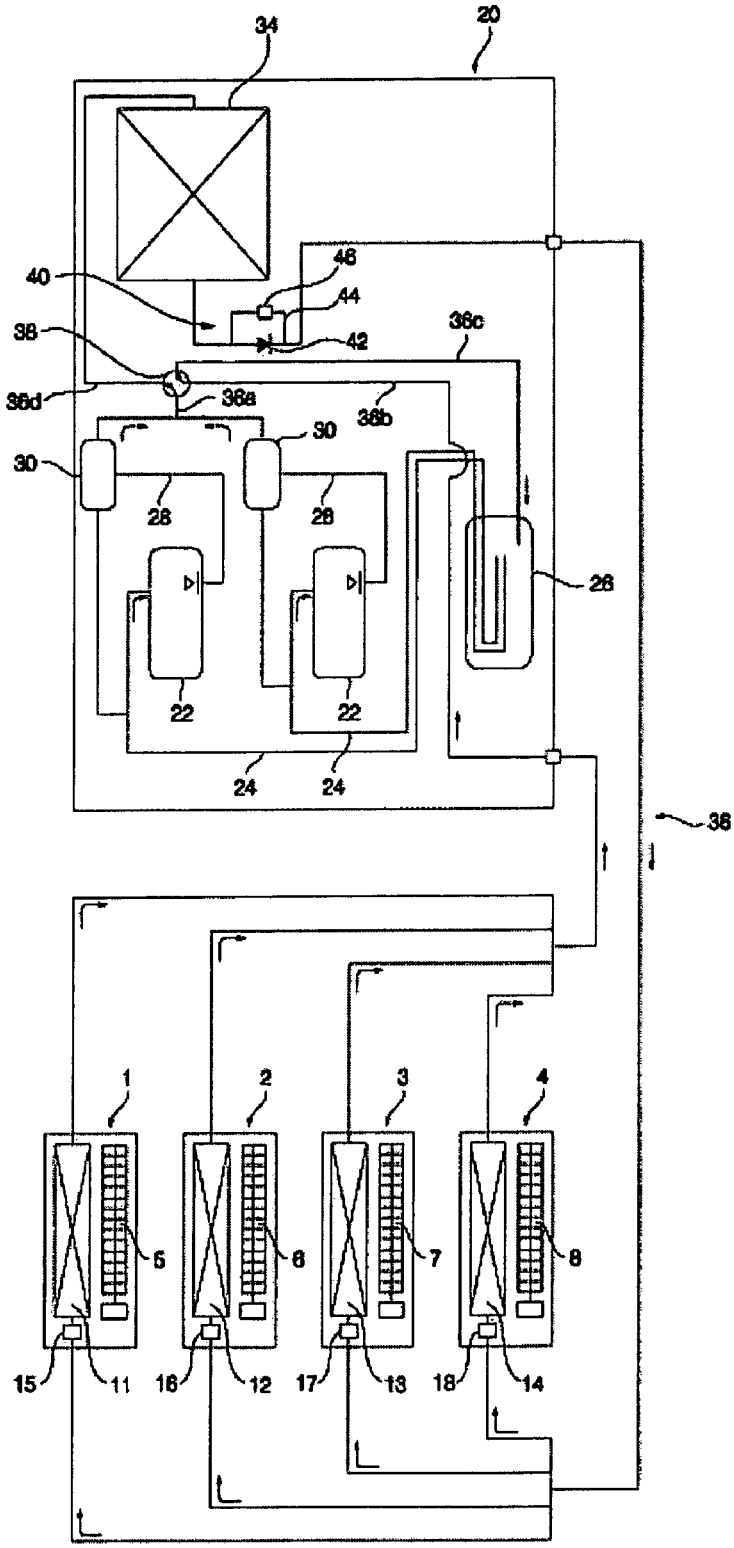
FIG. 1 (Prior art)
FIG. 1 is a schematic cycle diagram illustrating refrigerant flow in a cooling mode of a conventional multiple heat pump.
Figure 2:
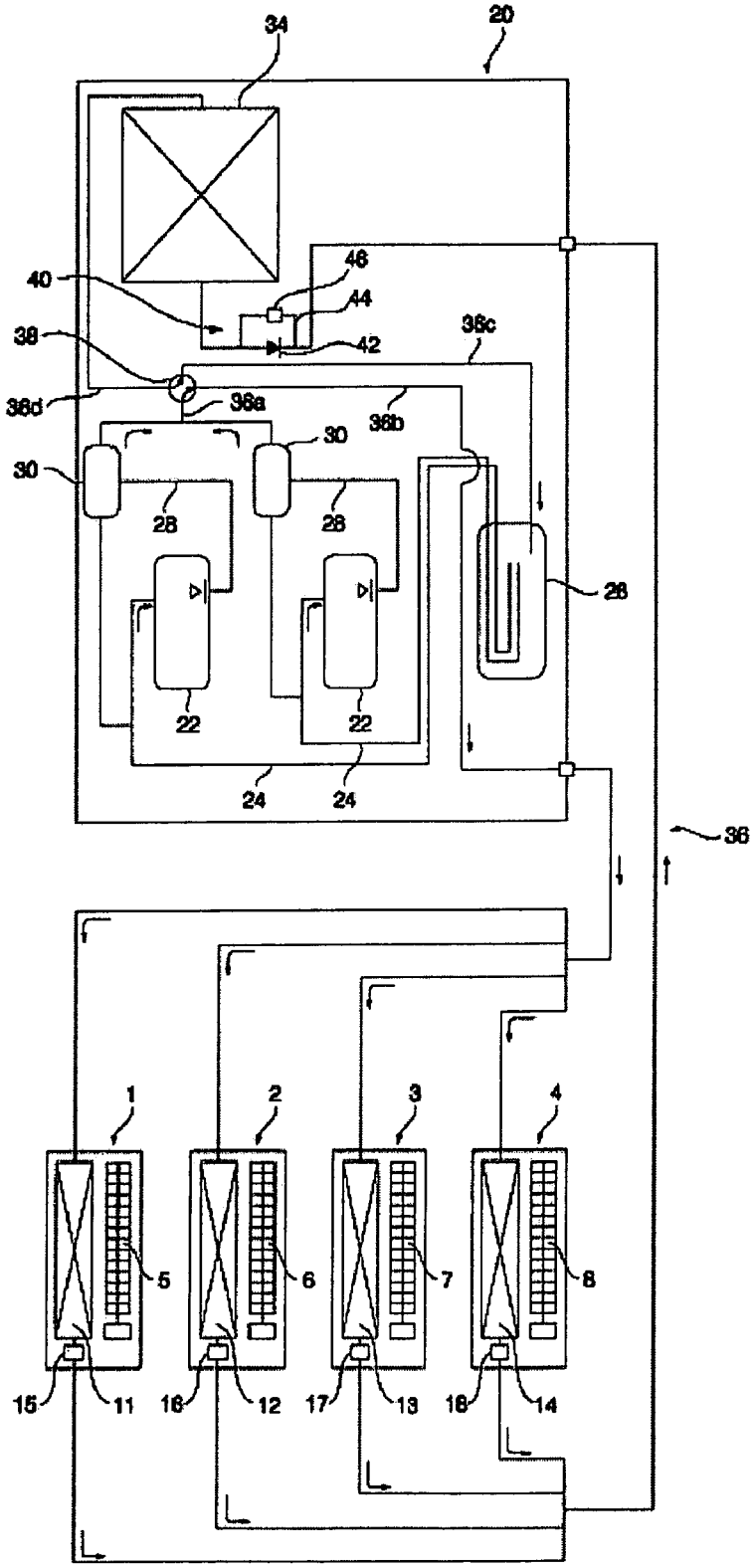
FIG. 2 (Prior art)
FIG. 2 is a schematic cycle diagram illustrating refrigerant flow in a heating mode of the conventional multiple heat pump.
Figure 3:
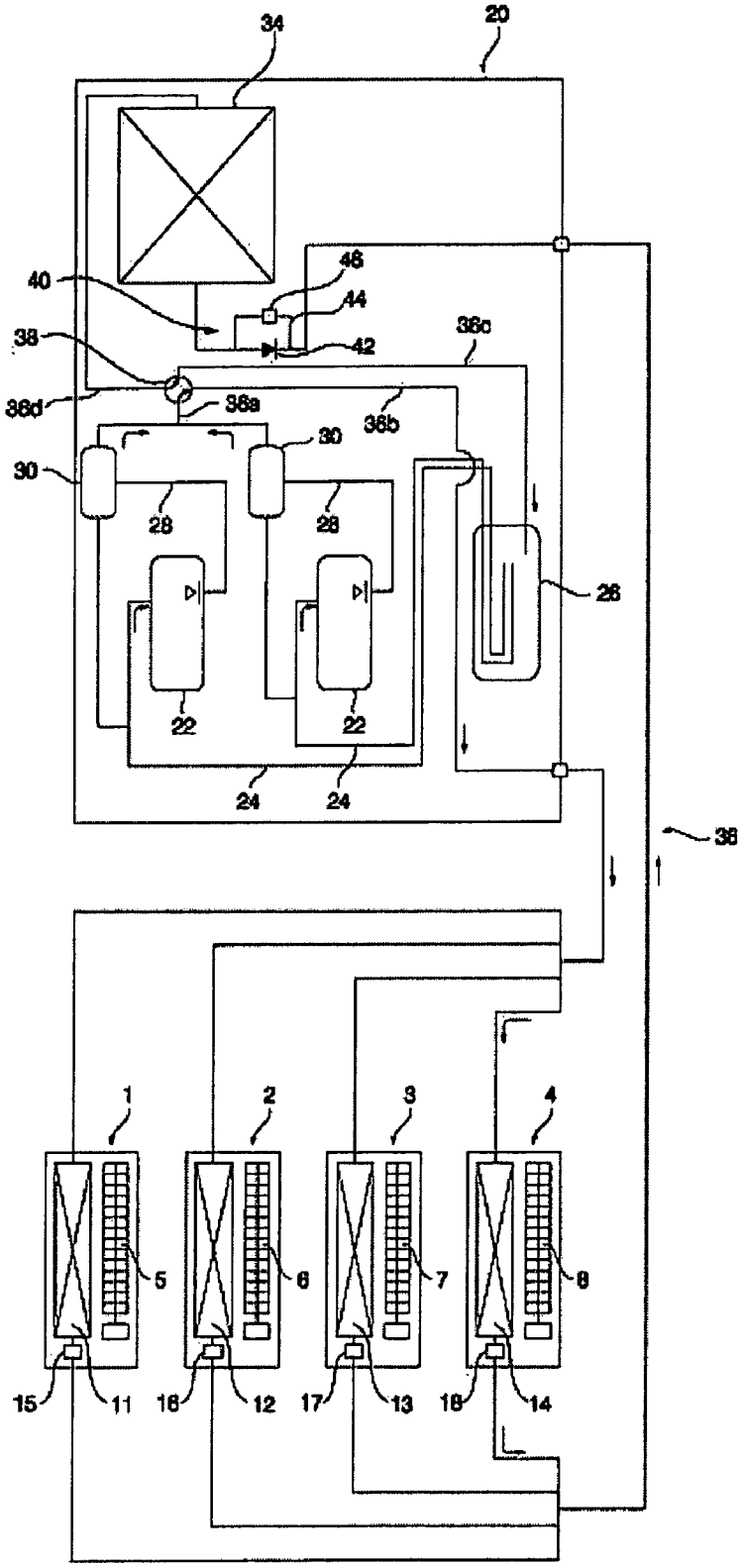
FIG. 3 (Prior art)
FIG. 3 is a schematic cycle diagram illustrating refrigerant flow when one of multiple indoor units of the conventional multiple heat pump operates in a heating mode and the other indoor units shut down.

Now, preferred embodiments of a control method for a multiple heat pump according to the present invention will be described in detail with reference to FIGS. 4 to 8. Hereinafter, constituent elements of the multiple heat pump according to the present invention respectively corresponding to those of the above described conventional multiple heat pump are designated by the same reference numerals and no detailed description thereof will be given.

Figure 4:
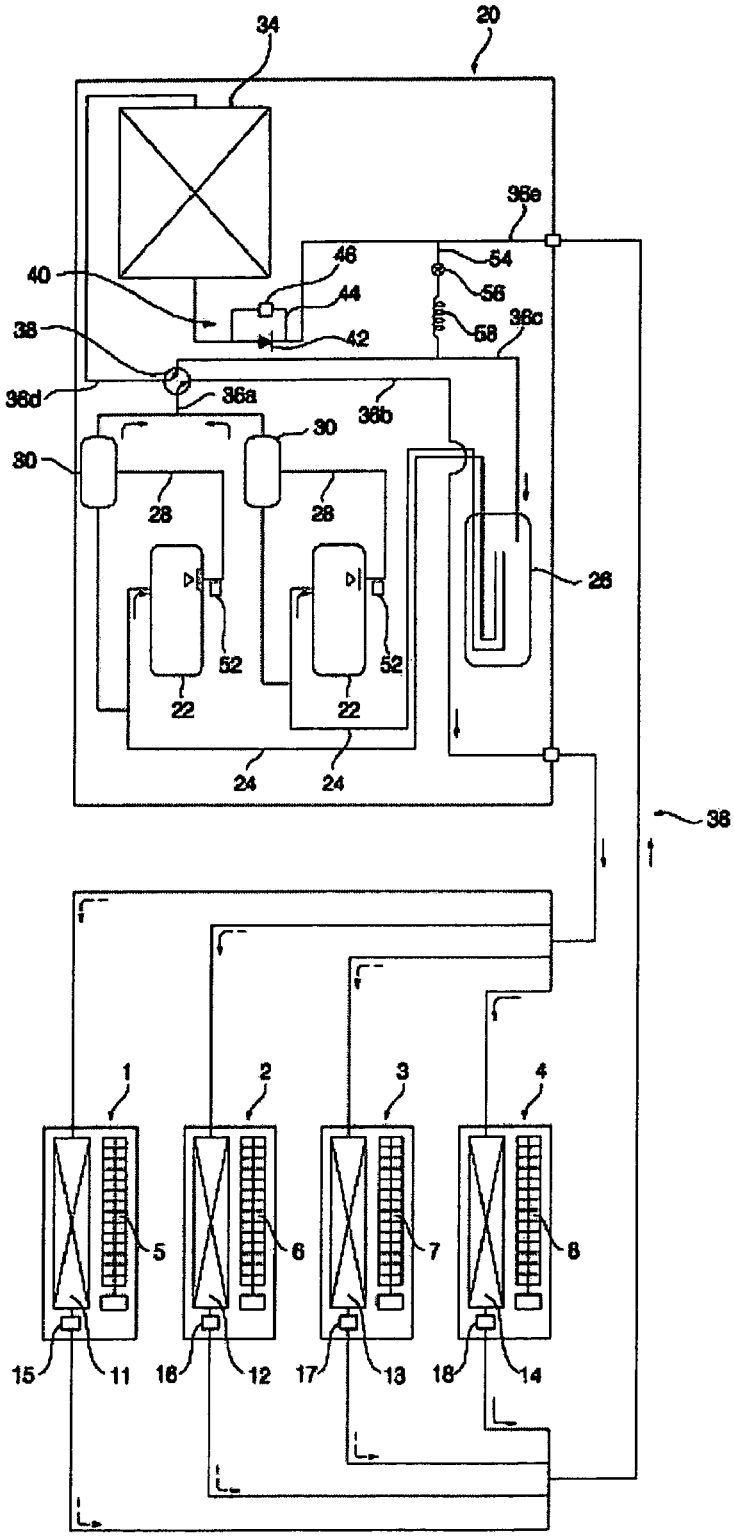
FIG. 4 is a schematic cycle diagram illustrating refrigerant flow in a multiple heat pump according to the present invention, when one of multiple indoor units operates in a heating mode and the other indoor units shut down.

FIG. 4 is a schematic cycle diagram illustrating refrigerant flow in a multiple heat pump according to the present invention, when one of multiple indoor units operates in a heating mode and the other indoor units shut down.

As shown in FIG. 4, the multiple heat pump according to the present invention comprises multiple indoor units 1, 2, 3 and 4, and a single outdoor unit 20.

Each of the indoor units 1, 2, 3 or 4 is provided with an indoor blower 5, 6, 7 or 8 that suctions indoor air thereinto and discharge it again to a room, an indoor heat exchanger 11, 12, 13 or 14 that heat exchanges the indoor air, suctioned into the indoor unit, with a refrigerant, so as to heat or cool the air, and an indoor electronic expansion valve 15, 16, 17 or 18 that permits the refrigerant passing therethrough to expand in cooling/heating modes.

The outdoor unit 20 is comprised of compressors 22, an accumulator 26, oil separators 30, an outdoor heat exchanger 34 an outdoor blower 35, a four-way valve 38, a check valve 42, a bypass pipe 44 and an outdoor electronic expansion valve 46. The compressors 22 are used to compress a refrigerant, and the accumulator 26, connected to refrigerant suction pipes 24 of the compressors 22, is used to accumulate a liquid refrigerant so as to permit only a gas refrigerant to be introduced into the compressors 22. The oil separators 30 are connected to refrigerant discharge pipes 28 of the respective compressors 22 in order to separate oil discharged together with the refrigerant from the compressors 22. The outdoor heat exchanger 34 serves to heat exchange the refrigerant with outside air, and the outdoor blower 35 serves to suction outside air into the outdoor unit 20 and discharges it again to the outside after the outside air passes through the outdoor heat exchanger 34. The four-way valve 38 is connected to the oil separators 30, indoor heat exchangers 11, 12, 13 and 14, accumulator 26 and outdoor heat exchanger 34 via refrigerant pipes 36*a*, 36*b*, 36*c* and 36*d*, and is used to switch a refrigerant channel in order to selectively send the refrigerant, passed through the oil separators 30, to the indoor heat exchangers 11, 12, 13 and 14 or outdoor heat exchanger 34. The check valve 42 is provided at the refrigerant pipe 36 connected to the outdoor heat exchanger 34 and is used to pass the refrigerant in the cooling mode and obstruct the refrigerant in the heating mode, and the bypass pipe 44 is used to divert the refrigerant obstructed by the check valve 42. The outdoor electronic expansion valve 46 is provided at the bypass pipe 44 to expand the refrigerant passing through the bypass pipe 44.

Each of the refrigerant discharge pipes 28 of the compressors 22 is provided with an outlet temperature sensor 52 to sense a temperature at the outlet side of the compressors 22.

The outdoor unit 20 further comprises a bypass pipe 54 to divert part of the liquid refrigerant to the compressors 22, a bypass valve 56 provided at the bypass pipe 54 to perform diversion of the liquid refrigerant, and an orifice 58 to expand the liquid refrigerant, passed through the bypass valve 56, to a low-temperature and low-pressure refrigerant.

One end of the bypass pipe 54 is connected to a refrigerant pipe 36*e* extending between the outdoor electronic expansion valve 46 and the indoor electronic expansion valves 15, 16, 17 and 18, and the other end of the bypass pipe 54 is connected to the refrigerant pipe 36*c* between the four-way valve 38 and the accumulator 26. Alternatively, the other end of the bypass pipe 54 may be directly connected to the compressors 22.

The bypass valve 56 is a solenoid valve that selectively intercepts passage of the liquid refrigerant as it is opened or closed.

Figure 5:
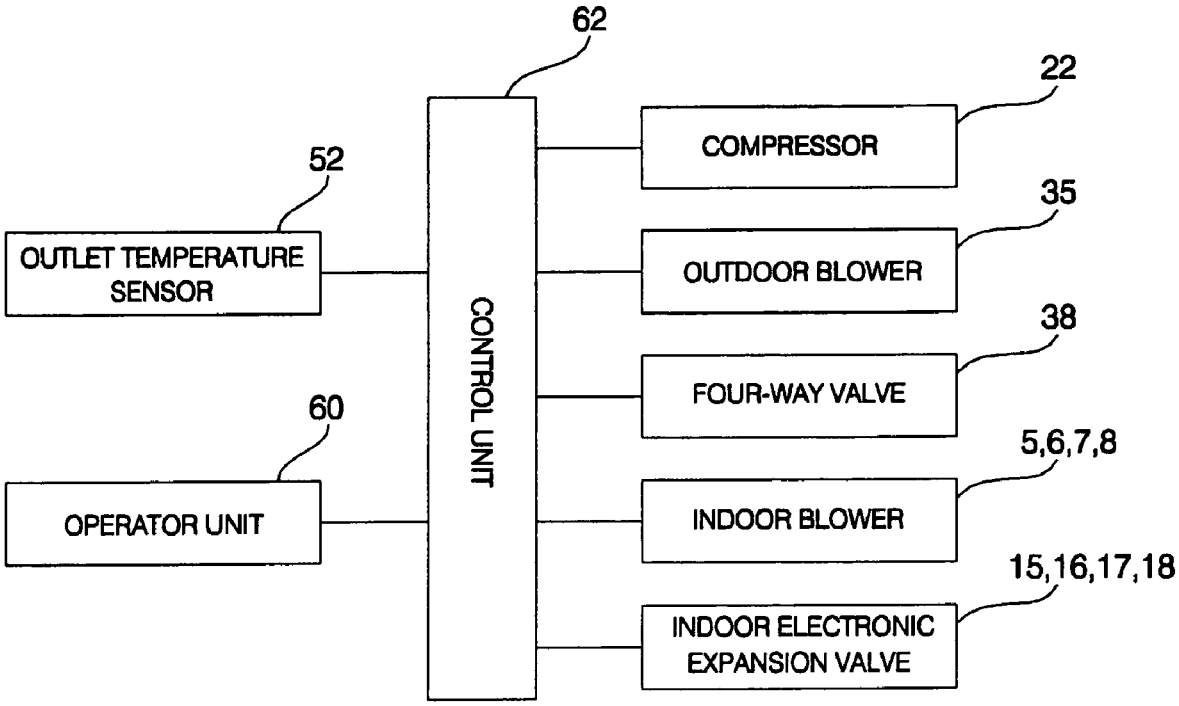
FIG. 5 is a block diagram illustrating a control system of the multiple heat pump according to the present invention.

FIG. 5 is a block diagram illustrating a control system of the multiple heat pump according to the present invention.

The multiple heat pump of the present invention further comprises an operator unit 60 to independently operate the respective outdoor units 1, 2, 3 and 4, and a control unit 62 that controls the compressors 22, four-way valve 38 and outdoor blower 35 of the outdoor unit 20 according to operation of the operator unit 60 or a temperature sensed by the outlet temperature sensors 52. The control unit 62 also controls the indoor blowers 5, 6, 7 and 8 and the indoor electronic expansion valves 15, 16, 17 and 18 of the indoor units 1, 2, 3 and 4.

Figure 6:
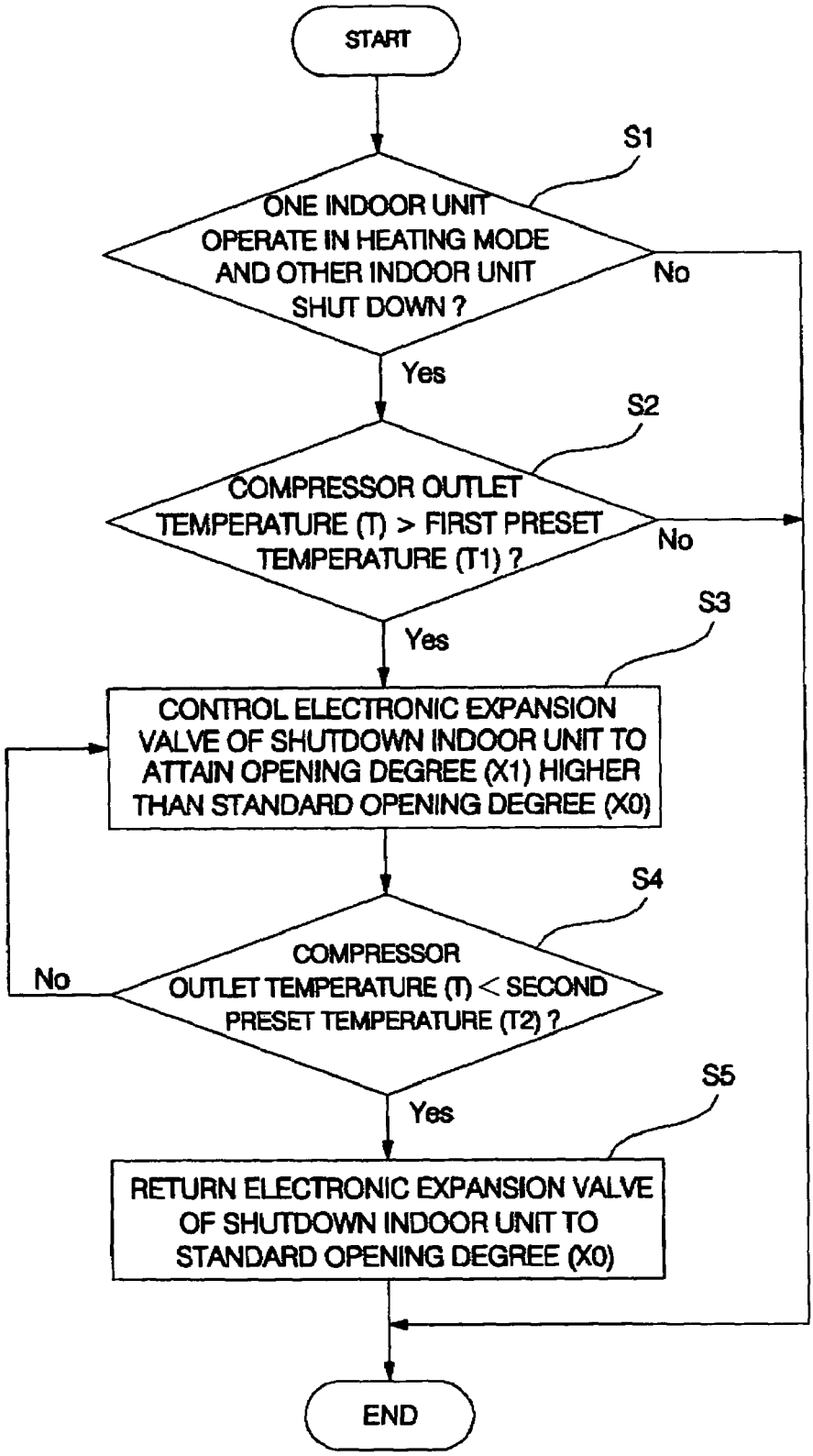
FIG. 6 is a flow chart illustrating a control method for the multiple heat pump according to a first embodiment of the present invention.

FIG. 6 is a flow chart illustrating a control method for the multiple heat pump according to a first embodiment of the present invention.

First, when one of the multiple indoor units 4 operates in a heating mode and the other indoor units 1, 2 and 3 shut down, the control unit 62 compares a temperature T sensed by the outlet temperature sensors 52 with a first preset temperature $T_1$ (S1 and S2).

Here, the first preset temperature $T_1$ is a standard temperature for determining whether or not an opening degree of the electronic expansion valves 15, 16 and 17 of the shutdown indoor units 1, 2 and 3 has to be changed.

If the temperature T sensed by the outlet temperature sensors 52 is higher than the first preset temperature $T_1$, the control unit 62 controls the electronic expansion valves 15, 16 and 17 of the shutdown indoor units 1, 2 and 3 to attain an opening degree $X_1$ higher than a standard opening degree $X_0$ (S3).

The standard opening degree $X_0$ is a standard preset opening degree upon shutdown of the indoor units.

If the electronic expansion valves 15, 16 and 17 of the shutdown indoor units 1, 2 and 3 are controlled to have the opening degree $X_1$ higher than the standard opening degree $X_0$, the liquid refrigerant, remaining in the indoor heat exchangers 11, 12 and 13 of the shutdown indoor units 1, 2 and 3, passes through the electronic expansion valves 15, 16 and 17 of the shutdown indoor units 1, 2 and 3 (designated by dotted arrows shown in FIG. 4) and is recovered to the compressors 22 together with the remaining refrigerant passed through the electronic expansion valve 18 of the operating indoor unit 4 (designated by solid arrows shown in FIG. 4), thereby being used to cool the compressors 22 without a conventional refrigerant shortage problem of the compressors 22.

After changing the opening degree of the electronic expansion valves 15, 16 and 17 of the shutdown indoor units 1, 2 and 3 to the opening degree $X_1$ higher than the standard opening degree $X_0$, the control unit 62 compares the temperature T sensed by the outlet temperature sensors 52 with a second preset temperature $T_2$ (S4).

Here, the second preset temperature $T_2$ is a standard temperature for determining whether or not the electronic expansion valves 15, 16 and 17 of the shutdown indoor units 1, 2 and 3 have to be returned to the standard opening degree $X_0$. The second preset temperature $T_2$ is set lower than the first preset temperature $T_1$.

If the temperature T sensed by the outlet temperature sensors 52 is higher than the second preset temperature $T_2$, the control unit 62 returns the opening degree of the electronic expansion valves 15, 16 and 17 of the shutdown indoor units 1, 2 and 3 to the standard opening degree $X_0$ (S5).

Figure 7:
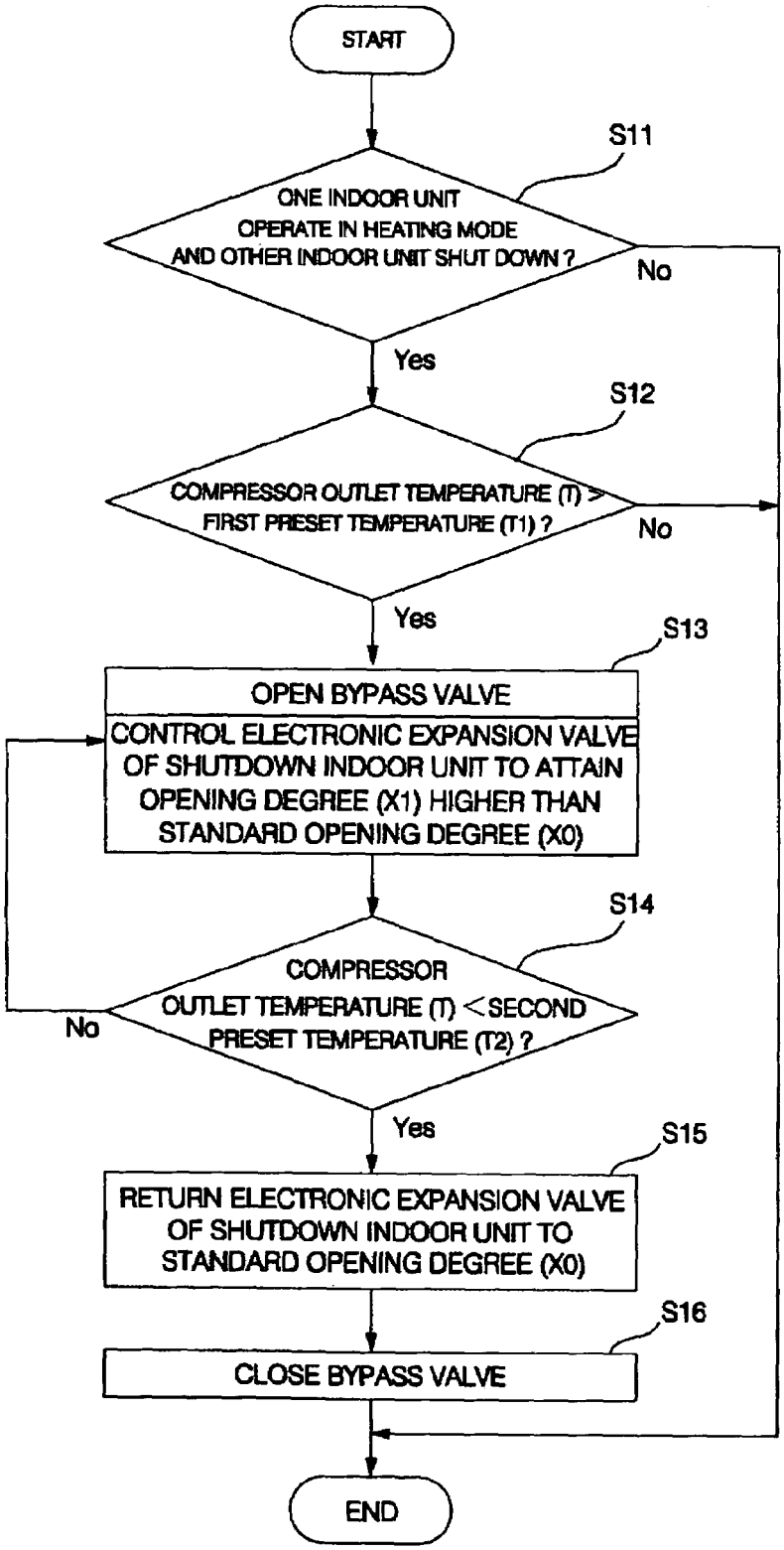
FIG. 7 is a flow chart illustrating a control method for the multiple heat pump according to a second embodiment of the present invention.

FIG. 7 is a flow chart illustrating a control method for the multiple heat pump according to a second embodiment of the present invention.

First, when one of the multiple indoor units 4 operates in a heating mode and the other indoor units 1, 2 and 3 shut down, the control unit 62 compares a temperature T sensed by the outlet temperature sensors 52 with a first preset temperature $T_1$ (S11 and S12).

Here, the first preset temperature $T_1$ is a standard temperature for determining whether or not an opening degree of the electronic expansion valves 15, 16 and 17 of the shutdown indoor units 1, 2 and 3 have to be changed and for determining whether or not the bypass valve 56 has to be opened.

If the temperature T sensed by the outlet temperature sensors 52 is higher than the first preset temperature $T_1$, the control unit 62 opens the bypass valve 56 so as to divert part of the refrigerant and recover it to the compressors 22 after expansion. At the same time, the control unit 62 controls the electronic expansion valves 15, 16 and 17 of the shutdown indoor units 1, 2 and 3 to attain an opening degree $X_1$ higher than a standard opening degree $X_0$ (S13).

The standard opening degree $X_0$ is a standard preset opening degree upon shutdown of the indoor units.

Here, it should be understood that the opening degree of the respective electronic expansion valves 15, 16 and 17 of the indoor units 1, 2 and 3 can be set to a single fixed value higher than the standard opening degree $X_0$, or to gradually increase.

That is, the opening degree $X_1$, higher than the standard opening degree $X_0$, can be set to first to three preset opening degrees between the standard opening degree $X_0$ and a maximum opening degree, for example, a quarter, a half and three quarters of the maximum opening degree. This permits a gradual increase in the opening degree of the electronic expansion valves 15, 16 and 17 of the indoor units 1, 2 and 3, enabling stepwise control of the electronic expansion valves 15, 16 and 17 of the indoor units 1, 2 and 3.

When the bypass valve 56 is opened, part of the two-phase refrigerant, transferred to the outdoor heat exchanger 34 by passing through the electronic expansion valve 18 of the opening indoor unit 4, is diverted to the bypass pipe 54, thereby being expanded to a low-temperature and low-pressure gas refrigerant by the orifice 58. Then, the gas refrigerant is returned to the compressors 22, cooling the compressors 22.

If the electronic expansion valves 15, 16 and 17 of the shutdown indoor units 1, 2 and 3 are controlled to have the opening degree $X_1$ higher than the standard opening degree $X_0$, the liquid refrigerant, remaining in the indoor heat exchangers 11, 12 and 13 of the shutdown indoor units 1, 2 and 3, passes through the electronic expansion valves 15, 16 and 17 of the shutdown indoor units 1, 2 and 3 (designated by dotted arrows shown in FIG. 4), and is recovered to the compressors 22 together with the remaining refrigerant passed through the electronic expansion valve 18 of the operating indoor unit 4 (designated by solid arrows shown in FIG. 4), thereby being used to cool the compressors 22 without a conventional refrigerant shortage problem of the compressors 22.

After changing the opening degree of the electronic expansion valves 15, 16 and 17 of the shutdown indoor units 1, 2 and 3 to the opening degree $X_1$ higher than the standard opening degree $X_0$, the control unit 62 compares the temperature T sensed by the outlet temperature sensors 52 with a second preset temperature $T_2$ (S14).

Here, the second preset temperature $T_2$ is a standard temperature for determining whether or not the electronic expansion valves 15, 16 and 17 of the shutdown indoor units 1, 2 and 3 have to be returned to the standard opening degree $X_0$ or for determining whether or not the bypass valve 56 has to be closed. The second preset temperature $T_2$ is set lower than the first preset temperature $T_1$.

If the temperature T sensed by the outlet temperature sensors 52 is higher than the second preset temperature $T_2$, the control unit 62 returns the opening degree of the electronic expansion valves 15, 16 and 17 of the shutdown indoor units 1, 2 and 3 to the standard opening degree $X_0$ (S15).

Then, the bypass valve 56 is closed (S16).

Meanwhile, if the temperature T sensed by the outlet temperature sensors 52 is not higher than the second preset temperature $T_2$, the control unit 62 opens the bypass valve 56 and controls the electronic expansion valves 15, 16 and 17 of the shutdown indoor units 1, 2 and 3 to have the opening degree $X_1$ higher than the standard opening degree $X_0$ (S14 and S13)

Figure 8:
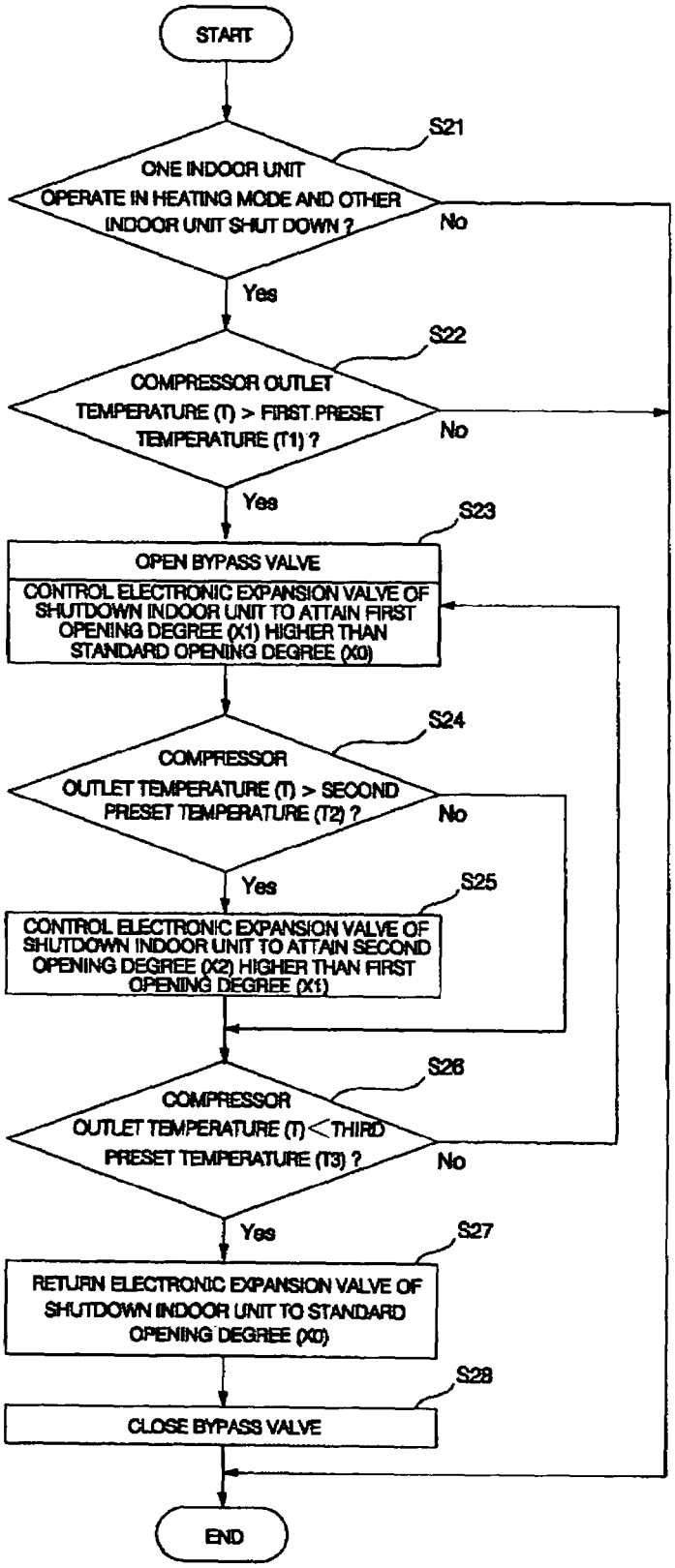
FIG. 8 is a flow chart illustrating a control method for the multiple heat pump according to a third embodiment of the present invention.

FIG. 8 is a flow chart illustrating a control method for the multiple heat pump according to a third embodiment of the present invention.

First, when one of the multiple indoor units 4 operates in a heating mode and the other indoor units 1, 2 and 3 shut down, the control unit 62 compares a temperature T sensed by the outlet temperature sensors 52 with a first preset temperature $T_1$ (S21 and S22).

Here, the first preset temperature $T_1$ is a standard temperature for determining whether or not the opening degree of the electronic expansion valves 15, 16 and 17 of the shutdown indoor units 1, 2 and 3 has to be changed to a first opening degree and for determining whether or not the bypass valve 56 has to be opened.

If the temperature T sensed by the outlet temperature sensors 52 is higher than the first preset temperature $T_1$, the control unit 62 opens the bypass valve 56 so as to divert part of the refrigerant and recover it to the compressors 22 after expansion. At the same time, the control unit 62 controls the electronic expansion valves 15, 16 and 17 of the shutdown indoor units 1, 2 and 3 to attain a first opening degree $X_1$ higher than a standard opening degree $X_0$ (S23).

The standard opening degree $X_0$ is a standard preset opening degree upon shutdown of the indoor units.

When the bypass valve 56 is opened, part of the two-phase refrigerant, transferred to the outdoor heat exchanger 34 by passing through the electronic expansion valve 18 of the opening indoor unit 4, is diverted to the bypass pipe 54, thereby being expanded to a low-temperature and low-pressure gas refrigerant by the orifice 58. Then, the gas refrigerant is returned to the compressors 22, cooling the compressors 22.

If the electronic expansion valves 15, 16 and 17 of the shutdown indoor units 1, 2 and 3 are controlled to have the first opening degree $X_1$ higher than the standard opening degree $X_0$, the liquid refrigerant, remaining in the indoor heat exchangers 11, 12 and 13 of the shutdown indoor units 1, 2 and 3, passes through the electronic expansion valves 15, 16 and 17 of the shutdown indoor units 1, 2 and 3 (designated by dotted arrows shown in FIG. 4), and is recovered to the compressors 22 together with the remaining refrigerant passed through the electronic expansion valve 18 of the operating indoor unit 4 (designated by solid arrows shown in FIG. 4), thereby being used to cool the compressors 22 without a conventional refrigerant shortage problem of the compressors 22.

Here, in consideration of heating effects of the shutdown indoor units 1, 2 and 3, the first opening degree $X_1$ is preferably set to a value below a fifth of a maximum opening degree $X_3$ of the electronic expansion valves 15, 16 and 17 of the indoor units 1, 2, 3 and 4.

That is, after being recovered to the compressors 22 and compressed again therein, the refrigerant is introduced into the respective indoor heat exchangers 11, 12, 13 and 14 of the indoor units 1, 2, 3 and 4. Here, the refrigerant, introduced into the indoor heat exchangers 11, 12 and 13 of the shutdown indoor units 1, 2 and 3, acts to heat the surroundings. Such heating of the shutdown indoor units 1, 2 and 3 can be minimized by setting the first opening degree $X_1$ to a value below a fifth of the maximum opening degree $X_3$ of the electronic expansion valves 15, 16 and 17.

Meanwhile, after the bypass valve 56 is opened and the electronic expansion valves 15, 16 and 17 of the shutdown indoor units 1, 2 and 3 are controlled to have the first opening degree $X_1$, the control unit 62 compares the temperature T sensed by the outlet temperature sensors 52 with a second preset temperature $T_2$ (S24).

Here, the second preset temperature $T_2$ is a standard temperature for determining whether or not the opening degree of the electronic expansion valves 15, 16 and 17 of the shutdown indoor units 1, 2 and 3 has to be changed to a second opening degree. The second preset temperature $T_2$ is set higher than the first preset temperature $T_1$.

If the temperature T sensed by the outlet temperature sensors 52 is higher than the second preset temperature $T_2$, the control unit 62 controls the electronic expansion valves 15, 16 and 17 of the shutdown indoor units 1, 2 and 3 to attain the second opening degree $X_2$ higher than the first opening degree $X_1$ (S25).

That is, since the outlet temperature of the compressors 22 exceeds the second preset temperature $T_2$ higher than the first preset temperature $T_1$ in spite of controlling the electronic expansion valves 15, 16 and 17 of the shutdown indoor units 1, 2 and 3 to attain the first opening degree $X_1$, the opening degree of the electronic expansion valves 15, 16 and 17 of the shutdown indoor units 1, 2 and 3 further increases.

If the electronic expansion valves 15, 16 and 17 of the shutdown indoor units 1, 2 and 3 are controlled to have the second opening degree $X_2$ higher than the first opening degree $X_1$, a greater amount of the liquid refrigerant, remaining in the indoor heat exchangers 11, 12 and 13 of the shutdown indoor units 1, 2 and 3, passes through the electronic expansion valves 15, 16 and 17 of the shutdown indoor units 1, 2 and 3 (designated by dotted arrows shown in FIG. 4), and then is recovered to the compressors 22 along with the refrigerant passed through the electronic expansion valve 18 of the operating indoor unit 4 (designated by solid arrows shown in FIG. 4), thereby being used to cool the compressors 22 without a conventional refrigerant shortage problem of the compressors 22.

Here, in consideration of the fact that the first opening degree $X_1$ achieves a minor refrigerant recovery efficiency, the second opening degree $X_2$ is preferably set to a value above a fifth of the maximum opening degree and below the maximum opening degree, in order to permit the liquid refrigerant, remaining in the electronic expansion valves 15, 16 and 17 of the shutdown indoor units 1, 2 and 3, to be sufficiently recovered to the compressors 22.

Meanwhile, if the temperature T sensed by the outlet temperature sensors 52 is not higher than the second preset temperature $T_2$, or after the electronic expansion valves 15, 16 and 17 of the shutdown indoor units 1, 2 and 3 are controlled to have the second opening degree $X_2$, the control unit 62 compares the temperature T sensed by the outlet temperature sensors 52 with a third preset temperature $T_3$ (S26).

Here, the third preset temperature T3 is a standard temperature for determining whether or not the opening degree of the electronic expansion valves 15, 16 and 17 of the shutdown indoor units 1, 2 and 3 has to be returned to the standard opening degree $X_0$ or for determining whether or not the bypass valve 56 has to be closed. The third preset temperature $T_3$ is set lower than the first preset temperature $T_1$.

If the temperature T sensed by the outlet temperature sensors 52 is higher than the third preset temperature T3, the control unit 62 returns the opening degree of the electronic expansion valves 15, 16 and 17 of the shutdown indoor units 1, 2 and 3 to the standard opening degree $X_0$ (S27) Then, the bypass valve 56 is closed (S28).

On the contrary, if the temperature T sensed by the outlet temperature sensors 52 is not higher than the third preset temperature $T_3$, the control unit 62 opens the bypass valve 56 and controls the electronic expansion valves 15, 16 and 17 of the shutdown indoor units 1, 2 and 3 to attain the first opening degree $X_1$ higher than the standard opening degree $X_0$ (S26 and S23).

It will be clearly understood that the present invention is not limited to the above described embodiments and the annexed drawings, and is applicable to alternative embodiments wherein two outdoor units are provided and four or more indoor units are connected to an outdoor unit.

As apparent from the above description, according to a control method for a multiple heat pump of the present invention, when one of multiple indoor units operates in a heating mode and the other indoor units shut down, electronic expansion valves of the shutdown indoor units are controlled to have an opening degree higher than a standard opening degree if an outlet temperature of compressors is higher than a preset temperature, so as to permit a liquid refrigerant, remaining in the shutdown indoor units, to be recovered to the compressors. This can solve a conventional refrigerant shortage problem of the compressors, preventing a deterioration of heating performance and a reduction of life-span of the compressors.

Further, according to the control method for the multiple heat pump of the present invention, when one of multiple indoor units operates in the heating mode and the other indoor units shut down, a bypass valve is opened and the electronic expansion valves of the shutdown indoor units are controlled to have the opening degree higher than the standard opening degree if the outlet temperature of compressors is higher than the preset temperature, so as to permit the liquid refrigerant, remaining in the shutdown indoor units, to be more readily recovered to the compressors.

Furthermore, the control method for the multiple heat pump according to the present invention can stepwise increase the opening degree of the electronic expansion valves of the shutdown indoor units, minimizing heating effects of the shutdown indoor units and enabling rapid recovery of the liquid refrigerant.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A control method for a multiple heat pump having multiple indoor units connected to an outdoor unit, the indoor units being controlled to operate in a cooling or heating mode, the method comprising:

opening a bypass valve to permit part of a refrigerant passing through a refrigerant pipe connected between tile indoor units and the outdoor unit to be diverted and compressors supplied to an acctunulator after being expanded by passing through a capillary tube and increasing an opening degree of electronic expansion valves of shutdown indoor units if an outlet temperature of the compressors is higher than a first preset temperature, in a state in which at least one of the multiple indoor units operates in the heating mode; and returning the opening degree of the electronic expansion valves of the shutdown indoor units to a standard opening degree if the outlet temperature of the compressors is below a second preset temperature, during increase of the opening degree of the electronic expansion valves.

2. The method as set forth in claim 1, wherein the outlet temperature of the compressors is a temperature sensed by outlet temperature sensors provided at refrigerant discharge pipes of the compressors.

3. The method as set forth in claim 1, wherein the refrigerant, expanded in the electronic expansion valves of the multiple indoor units, is diverted as the bypass valve is opened.

4. The method as set forth in claim 1, wherein the increase of the opening degree of the electronic expansion valves is performed in a stepwise manner.

5. The method as set forth in claim 1, wherein the increase of the opening degree of the electronic expansion valves is performed so that the opening degree reaches a preset opening degree higher than the standard opening degree.

6. The method as set forth in claim 1, wherein the second preset temperature is lower than the first preset temperature.

7. The method as set forth in claim 1, wherein the standard opening degree is a standard preset opening degree upon shutdown of the indoor units.

8. A control method for a multiple heat pump having multiple indoor units connected to an outdoor unit, the indoor units being controlled to operate in a cooling or heating mode, the method comprising:

opening a bypass valve to permit part of a refrigerant to be diverted and recovered to compressors after being expanded and increasing an opening degree of electronic expansion valves of shutdown indoor units if an outlet temperature of the compressors is higher than a first preset temperature, in a state in which one of the multiple indoor units operates in the heating mode; and returning the opening degree of the electronic expansion valves of the shutdown indoor units to a standard opening degree if the outlet temperature of the compressors is below a second preset temperature, during increase of the opening degree of the electronic expansion valves wherein the return of the opening degree of the electronic expansion valves to the standard opening degree is performed by closing the bypass valve.

9. A control method for a multiple heat pump having multiple indoor units connected to an outdoor unit, the indoor units being controlled to operate in a cooling or heating mode, the method comprising:

opening a bypass valve to permit part of a refrigerant to be diverted and recovered to compressors after being expanded and controlling electronic expansion valves of shutdown indoor units to attain a first opening degree higher than a standard opening degree if an outlet temperature of the compressors is higher than a first preset temperature, in a state in which one of the multiple indoor units operates in the heating mode;

controlling the electronic expansion valves of the shutdown indoor units to attain a second opening degree higher than the first opening degree if the outlet temperature of the compressors is higher than a second preset temperature, after completing control of the electronic expansion valves to the first opening degree; and returning the opening degree of the electronic expansion valves of the shutdown indoor units to the standard opening degree if the outlet temperature of the compressors is below a third preset temperature, after completing control of the electronic expansion valves to the second opening degree.

10. The method as set forth in claim 9, wherein the refrigerant, expanded in the electronic expansion valves of the multiple indoor units, is diverted as the bypass valve is opened.

11. The method as set forth in claim 9, wherein the standard opening degree is a standard preset opening degree upon shutdown of the indoor units.

12. The method as set forth in claim 9, wherein the first opening degree is a value below a fifth of a maximum opening degree of the electronic expansion valves of the indoor units.

13. The method as set forth in claim 9, wherein the second preset temperature is higher than the first preset temperature.

14. The method as set forth in claim 9, wherein the second opening degree is a value above a fifth of a maximum opening degree of the electronic expansion valves and below the maximum opening degree.

15. The method as set forth in claim 9, wherein the third preset temperature is lower than the first preset temperature.

16. The method as set forth in claim 9, wherein the return of the opening degree of the electronic expansion valves to the standard opening degree is performed by closing the bypass valve.

* * * * *